United States Patent [19]

Hagiwara et al.

[11] Patent Number: 4,723,716

[45] Date of Patent: Feb. 9, 1988

[54] OPERATIONAL CONTROL METHOD FOR CYLINDRICAL CRUSHER

[75] Inventors: Tatsuo Hagiwara, Funabashi; Keiji Imai, Ibaraki; Kyoichi Yahagi, Matsudo; Shigenori Nagaoka, Chiba, all of Japan

[73] Assignees: Kawasaki Jukogyo Kabushiki Kaisha, Kobe; Ishii Syogi, Ltd., Tokyo, both of Japan

[21] Appl. No.: 908,268

[22] Filed: Sep. 17, 1986

[30] Foreign Application Priority Data

Sep. 25, 1985 [JP] Japan ..... 60-211750

[51] Int. Cl.[4] ..... B02C 25/00

[52] U.S. Cl. ..... 241/24; 241/34; 241/36

[58] Field of Search ..... 241/24, 30, 79, 34, 241/35, 36

[56] References Cited

U.S. PATENT DOCUMENTS 3,596,839 8/1971 Putman ..... 241/34 X

FOREIGN PATENT DOCUMENTS 34176 3/1979 Japan ..... 241/36

*Primary Examiner*—Mark Rosenbaum

*Attorney, Agent, or Firm*—Leydig, Voit & Mayer

[57] ABSTRACT

An operational control method for a cylindrical crusher in which furnace slag is supplied to the cylindrical crusher through supply means and said furnace slag is crushed to obtain a furnace slag product, wherein particle size distribution and iron content ratio of a furnace slag product are detected and variable control of a supplying amount from the supply means and/or revolution speed of a cylindrical crusher is carried out within a predetermined range.

9 Claims, 2 Drawing Figures

OPERATIONAL CONTROL METHOD FOR CYLINDRICAL CRUSHER

BACKGROUND OF THE INVENTION

The present invention is related to an operational control method for a cylindrical crusher.

Most of blast furnace slag, convertor slag and electric furnace slag or the like produced in the processes of iron manufacture and steel manufacture had been disposed by throwing away. However, in recent years because of decrease of reclaimable land and in view of effective utilization of resources, recovery of an iron content from slag and reuse of the slag for aggregate etc. have been practiced. In this reason, by conducting such operations as a crushing process for rough breaking or deformation of massive furnace slag and then additional successive smashing process as well as sift sorting and magnetic separation procedures and the like, a concentrate whose iron content ratio is high is separated then withdrawn, and it is reused as a slag product and also an aggregate. In addition, in the crushing process of the rough breaking or deformation of the massive furnace slag a swingable type crushing apparatus (U.S. Pat. No. 4,637,562) or the like is utilized, while in the process of the pulverizing or grinding of the slag of a cylindrical crusher of a rod mill or the like is employed.

In such a way, the massive furnace slag whose dimension is greater than 300–500 mm and whose iron content ratio is about 50–60% is gradually decreased in size up to approximately 0–50 mm, and such a furnace slag as having the iron content ratio of 90–98% can be obtained.

The furnace slag is a non-uniform aggregation which is composed of melt iron and fused ore slag etc. When the slag is under the crushing operation, selective crushing proceeds in such a manner that the crushing is developed from the boundary portion or the like as the starting point where the iron content ratio is poor but ore slag content ratio is rich and the strength is low, thereby selectively crushing the furnace slag into one which has high strength and a rich iron content ratio and the other which has low strength and a poor iron content ratio. In this case, in the crushing process the crushing operation is performed in a crushing circuit where the supply means of the furnace slag and the cylindrical crusher is connected in series, and furnace slag of a certain dimensions is supplied to produce the furnace slag product with fine particle size. The particle size of this crushed product depends on the supplying amount from the supply means; the diameter and length of the cylindrical crusher; configuration, dimensions and fill-up quantity of media to be crushed; and the revolution speed of the cylindrical crusher and the like. In an ordinal operation, when the properties and dimension of the furnace slag are uniform, the particle size of the slag particularly depends on the supplying amount from the supply means and the revolution speed of the cylindrical crusher. The crushed product of the furnace slag produced under such operations is further subjected to the operations such as the sift sorting and the magnetic separation and so forth, whereby the ore slag is separated from the crushed product to be removed so that the furnace slag product which has high iron content ratio can be obtained.

However, in the operational control method by the conventional cylindrical crusher explained hereinbefore, there are such problems that since the particle size distribution and the iron content ratio of the furnace slag product is not detected directly and the supplying amount from the supply means and/or the revolution speed of the cylindrical crusher are not variable controlled by the control device, when the properties, the configuration and the dimensions of the furnace slag vary, the properties, the configuration and the dimensions of the furnace slag produce may change remarkably, so that the furnace slag which provides appropriate particle size distribution and iron content ratio can not be produced efficiently.

An object of the present invention is to resolve these conventional problems and to provide an improved operational control method for a cylindrical crusher which can sufficiently effectively produce a furnace product having appropriate particle size distribution and iron content ratio to the substantial fluctuation in the properties and configuration of the furnace slag, while variably controlling the supplying amount from the supply means and the revolution speed of the cylindrical crusher.

SUMMARY OF THE INVENTION

In order to accomplish the purpose described above, the present invention is carried out in such a manner that particle size distribution and iron content ratio of a furnace slag product are detected and a supplying amount from a supply means and/or revolution speed of a cylindrical crusher are variably controlled within a predetermined range by a control device.

DESCRIPTION OF THE PREFERRED EMBODIMENT

Figure 1:
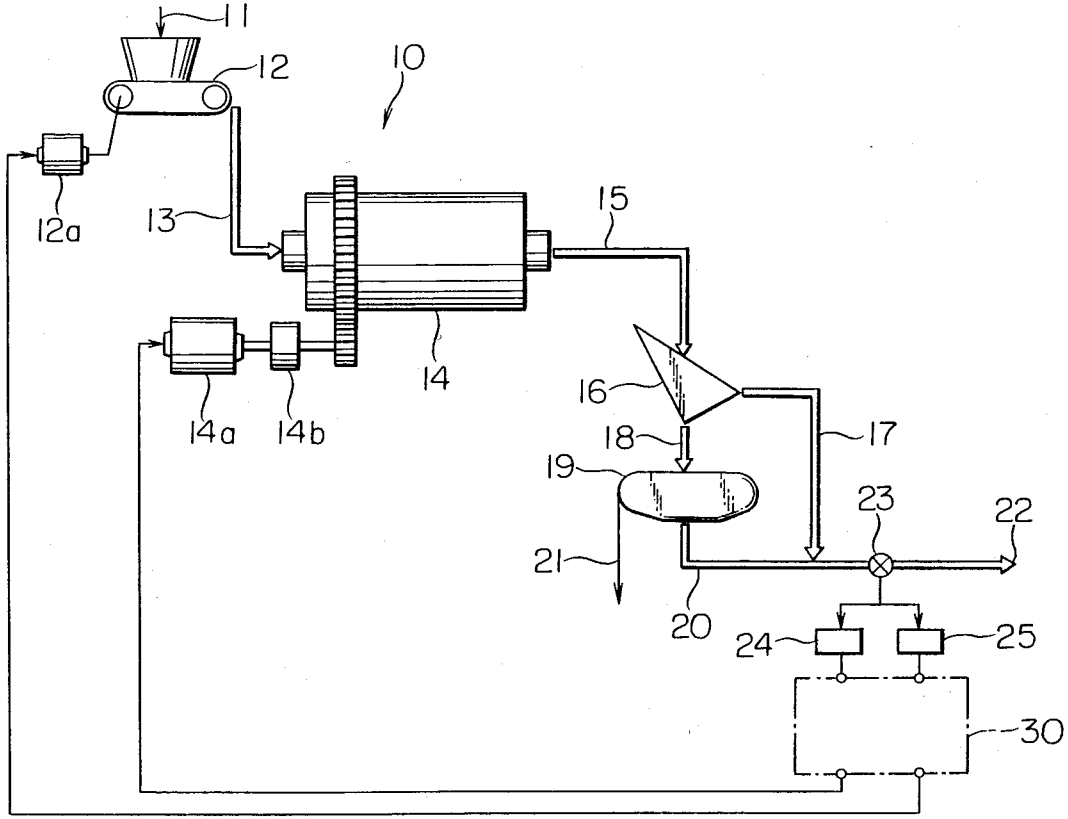
FIG. 1 is a diagrammatical process chart of an operational control method for a cylindrical crusher according to one embodiment of the present invention.

FIG. 1 shows a constitution of one embodiment of the present invention.

In FIG. 1, the reference numeral 10 designates the process of crushing furnace slag and the numerals 11, 12 and 13 exhibit furnace slag, supply means and supplied furnace slag respectively, and the numerals 14, 16 and 19 represent a cylindrical crusher, a griddle separator and a magnetic separator respectively.

The furnace slag 11 is supplied to the cylindrical crusher 14 through the supply means 12, and then the crushing of the slag is carried out. The numeral **12*a* is variable driving means for regulating a supply amount of the slag from the supplier 12, and the numeral 14*a* is variable driving means which enables to control a revolution speed of the cylindrical crusher 14. The numeral 14*b* is a speed reduction device. This crusher is provided with a sampling section 23 at a transfer passage for a furnace slag product 22 which is of a sorted high grade product 17 collected through the griddle separator 16 and a magnetic product 20** separated through the magnetic separator.

The reference numeral 30 is a control device, and the sampling section 23 is communicated with such a control device 30 through particle size measuring means 24 and iron content analysis means 25. Outlet signals from the control device 30 are inlet signals to respective control devices, which are not shown in the diagram, of the variable driving means 12*a* and 14*a*.

Both of the supplying amount of the furnace slag 11 into the cylindrical crusher 14 and the revolution speed of the crusher are variably operated by the driving of the above-mentioned variable driving means 12*a* and 14*a* which are controlled by outlet signals from the control device 30 on the basis of present values stored in the device, so that a crushed product 15 is discharged from the cylindrical crusher 14. The crushed product 15 has been subjected to the effection of the actuation of selective crushing, and in such a product a portion as rich in iron content ratio and a portion poor in iron content ratio are involved together. Succeedingly the crushed product is supplied to the griddle separator 16, and then the shifting sort for the crushed product is conducted to produce the sorted high grade product 17 and a sorted low grade product 18 under the vibration movement of a shifting surface in the separator. Because sorted high grade product 17 is high in iron content ratio, it becomes a part of the furnace slag product 22 without any process or after passing through an additional process. Since the sorted low grade product 18 is relatively lower in iron content ratio as compared with the stored high grade product 17, it is further supplied into the magnetic separator 19 for making magnetic separation to produce a magnetic product 20 which is rich in iron content ratio and ore slag 21 which does not substantially content iron, and then the magnetic product 20 is admixed with said sorted high grade product 17 to produce the furnace slag product 22.

The furnace slag product 22 from the sampling section 23 is delivered to the above-described particle size measuring means 24, and the iron content analysis means 25 by an automatic sampler which is not shown in the drawing.

Samples are continuously supplied into the particle size measuring means 24, in which by the successive operations such as multistage shifting operation and weighting operation and the like a gravimetric frequency analysis in each particle size classification, i.e., a particle size analysis is made to calculate and detect the gravimetric frequency of the samples. If necessary, the processing of data such as a largest particle size, a smallest particle size, 50% average particle size and cumulative value is carried out in a short time. While, in the iron content analysis means 25, the samples are supplied there where by physical operations such as aquatic bulk specific gravity measuring etc., the iron content ratio is calculated and detected.

As a correlation exists between the iron content ratio obtained by the particular analysis methods for the furnace slag product and the results of the above aquatic bulk specific gravity measuring, this relation may be utilized. As a result, also in the iron content analysis means 25, the short-time determination of iron content ratio of the furnace slag product becomes possible, and the detected informations are inputted to the control device 30 and then they are converted the output signals to be sent to the control devices of said variable driving means 12*a* and 14*a*.

With regard to the measuring methods in the above-mentioned particle size measuring means 24 and the iron content analysis means 25, employing a measuring method of a manual operation may be used in place of said mechanical successive operations.

In the inherent characteristics of the process by the cylindrical crusher 14, a quantity of the furnace slag which may be stored within the cylindrical crusher 14 is relatively large so that capacity delay can be expected, and the determination of said particle size distribution and the iron content ratio of the slag can be established in a short time, whereby the supplying amount from the supply means and the revolution speed of the cylindrical crusher can be continuously variably controlled within the predetermined range without giving.

Next, influence which is given no properties of the furnace slag produce 22 by controlling of the supplying amount from the supply means 12 and the operation speed of the cylindrical crusher 14, will be explained. In this case, the properties of the furnace slag 11, for example sorts of furnace slag, the iron content ratio, crushability and the like, and also configuration or dimension etc. exert an influence upon crushing performance.

When the steady operations for crushing the furnace slag 11 within the cylindrical crusher 14 rotating at the predetermined revolution speed under the predetermined amount of the furnace slag from the supply means is conducted to produce the furnace slag product 22, if variation in the properties or the like of the furnace slag 11 takes place and such slag continues to be supplied, the crushing sometimes advances more than it is required, so that the furnace slag product 22 of grain which is rich in iron content ratio can not be made. For this reason, the revolution speed of the cylindrical crusher 14 is reduced to regulate the crushing. However, such a operation makes reduction of the conduct capacity of the cylindrical crusher 14. On the contrary, in combination with increase of the supplying amount of the furnace slag from the supply means 12 this problem can be avoided.

Then a predetermined range for the revolution speed of the cylindrical crusher 14 is about 40–80% at N/Nc value. In this relation, N indicates the revolution speed of the cylindrical crusher 14 and Nc represents a critical revolution speed which is dominated by a diameter of the crusher cylinder but controls moving condition of the media to be crushed.

In the meanwhile, with regard to the relation between the sorts and properties of the furnace slag and the crushing capacity of the cylindrical crusher, the characteristic relation about various kinds of furnace slag is enabled to estimate previously. Accordingly, the characteristics may be memorized in the control device 30, and characteristic values of samples taken out of the sampling portion 23 which are determined by the particle size measuring means 24 and the iron content analysis means 25 are inputted to the control device in which necessary control calculation is carried out depending on the above preset values and the characteristic values, whereby the control signals to be sent to the variable driving means 12*a* and 14*a* of the supply means 12 an the cylindrical crusher 14 are outputted. In this way, the control device 30 can make the supplying amount from the supply means 12 and the revolution speed of the cylindrical crusher 14 operate variably within the predetermined range.

Figure 2:
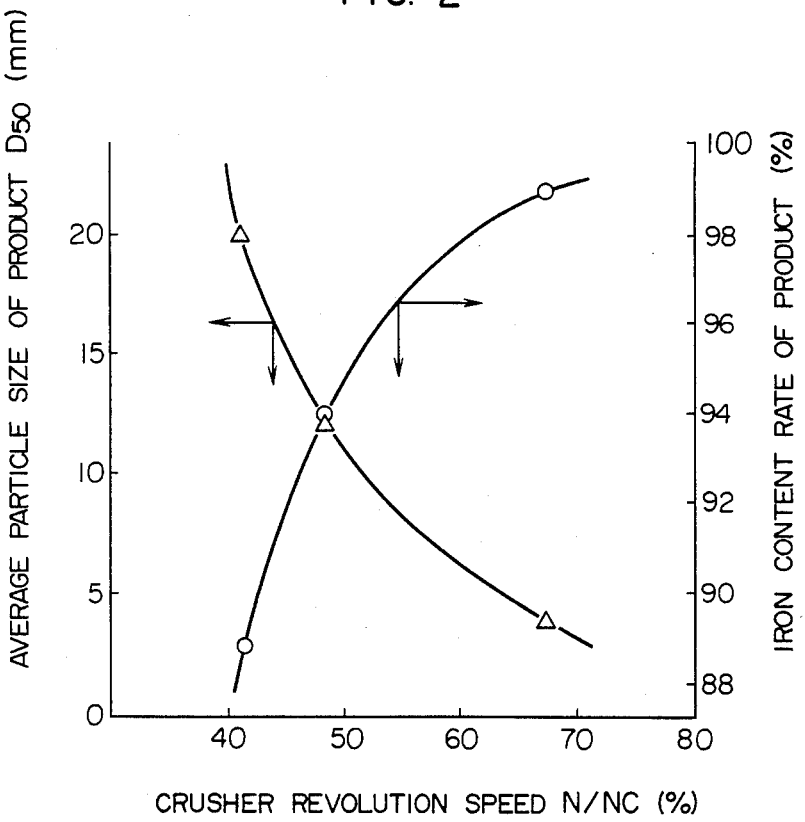
FIG. 2 is an explanatory view of crushing characteristics in the same method.

FIG. 2 shows an example of a crushing characteristic of furnace slag when using a cylindrical crusher.

The diagram designates that average particle size D50 (mm) and iron content ratio (%) of products may vary in response to the variation of the revolution speed N/Nc (%) of the cylindrical crusher.

The average particle size D50 means median diameter which corresponds to central cumulative value (50%) in the particle size cumulative curve.

In addition, the iron content ratio is changed from a value obtained by the aquatic bulk specific gravity measuring.

Besides, there is no doubt that the constitution or arrangement of the supply means, the cylindrical crusher and the control device utilized in the present invention is not limited to those in the above-mentioned embodiment.

In the present invention, as clearly understood from the above-described embodiment, the particle size distribution and the iron content ratio of the furnace slag product are initially detected, and during the operation of the supply means and the cylindrical crusher which are utilized for the crushing process the variable operation is established, then the furnace slag product which provides appropriate particle size distribution and also iron content ratio which correspond to large fluctuation in the properties and the configuration of the furnace slag can be produced sufficiently and effectively. Therefore, the crusher can be operated for obtaining required grade depending on respective applications of the furnace slag, and then such products are made out.

Further, it can be recognized that a combination with additional controlling operation of the supply means can make efficiently a control range wider and so forth, thus the effects of the invention are great.

What is claimed is:

1. An operational control method for a cylindrical crusher wherein furnace slag is supplied to the cylindrical crusher through supply means and said furnace slag is crushed to obtain a furnace slag product, characterized in that said method comprises the steps of detecting particle size distribution and iron content ratio of the furnace slag product and conducting variable control of supplying amount from the supply means and revolution speed of the cylindrical crusher by a control device within a predetermined range.

2. An operational control method for a cylindrical crusher according to claim 1, characterized in that said particle size distribution is determined by a griddle separator and particle size measuring means.

3. An operational control method for a cylindrical crusher according to claim 2, characterized in that a sorted low grade product from the griddle separator is separated by a magnetic separator into a magnetic product of high iron content ratio and ore slag which does not substantially include iron content.

4. An operational control method for a cylindrical crusher wherein furnace slag is supplied to the cylindrical crusher through supply means and said furnace slag is crushed to obtain a furnace slag product, characterized in that said method comprises the steps of detecting particle size distribution and iron content ratio of the furnace slag product and conducting variable control of revolution speed of the cyindrical crusher by a control device within a predetermined range.

5. An operational control method for a cylindrical crusher according to claim 4, characterized in that said particle size distribution is determined by a griddle separator and particle size measuring means.

6. An operational control method for a cylindrical crusher according to claim 5, characterized in that a sorted low grade product from the griddle separator is separated by a magnetic separator into a magnetic product of high iron content ratio and ore slag which does not substantially include iron content.

7. An operational control method for a cylindrical crusher wherein furnace slag is supplied to the cylindrical crusher through supply means and said furnace slag is crushed to obtain a furnace slag product, characterized in that said method comprises the steps of detecting particle size distribution and iron content ratio of the furnace slag product and conducting variable control of supplying amount from the supply means by a control device within a predetermined range.

8. An operational control method for a cylindrical crusher according to claim 7, characterized in that said particle size distribution is determined by a griddle separator and particle size measuring means.

9. An operational control method for a cylindrical crusher according to claim 8, characterized in that a sorted low grade product from the griddle separator is separated by a magnetic separator into a magnetic product of high iron content ratio and ore slag which does not substantially include iron content.

* * * * *